US006090324A

United States Patent [19]

Keady

[11] Patent Number: 6,090,324

[45] Date of Patent: Jul. 18, 2000

[54] FORMING SYSTEM FOR STONE BENCHES

[76] Inventor: Paul A. Keady, P.O. Box 242, Schurz, Nev. 89427

[21] Appl. No.: 09/112,326

[22] Filed: Jul. 9, 1998

[51] Int. Cl.[7] ..... B28B 23/00

[52] U.S. Cl. ..... 264/261; 249/83; 249/93; 249/139; 264/277; 264/333; 264/334

[58] Field of Search ..... 249/83, 93, 117, 249/139; 264/261, 277, 299, 333, 334

[56] References Cited

U.S. PATENT DOCUMENTS

| | | | |
|---|---|---|---|
| 244,847 | 7/1881 | Budd . | |
| 846,641 | 3/1907 | Addicks | 249/139 |
| 3,363,873 | 1/1968 | Barber et al. . | |
| 3,626,648 | 12/1971 | Beckham . | |
| 3,756,657 | 9/1973 | Johnson | 52/190 |
| 4,342,440 | 8/1982 | Eyden . | |

*Primary Examiner*—James P. Mackey
*Attorney, Agent, or Firm*—Patent & Trademark Services; Joseph H. McGlynn

[57] ABSTRACT

A forming system for constructing stone benches which incorporates a forming tray that has a central support extending therethrough. The central support is temporarily supported at opposite ends and temporary shoring is provided beneath the length of the forming tray. Concrete and stone are placed in the forming tray and allowed to set. Next, the set concrete and stone are removed from the forming tray and support legs are placed under the concrete and stone and they are lowered into final position.

4 Claims, 1 Drawing Sheet

FIG. 1
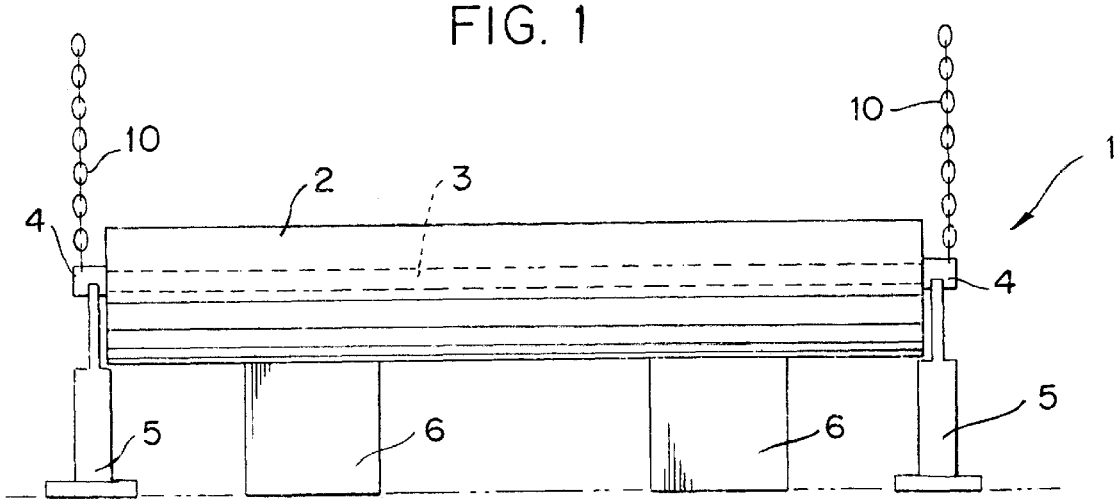
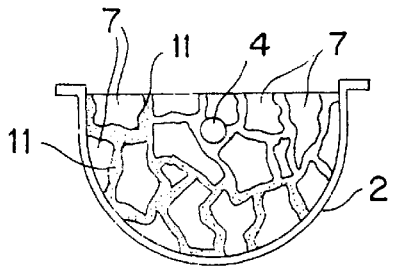
FIG. 2
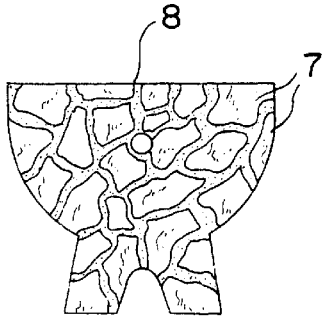
FIG. 3
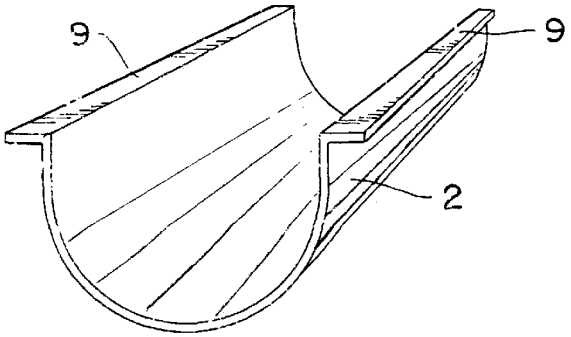
FIG. 4
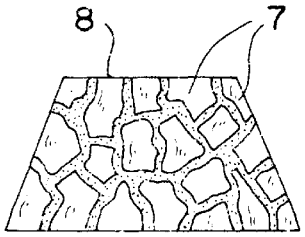
FIG. 5

FORMING SYSTEM FOR STONE BENCHES

BACKGROUND OF THE INVENTION

This invention relates, in general, to a forming system for structures, and, in particular, to a forming system for fabricating stone benches.

DESCRIPTION OF THE PRIOR ART

In the prior art various types of fabricating systems have been proposed. For example, U.S. Pat. No. 244,847 to Budd discloses a mold for making earth and stone fences comprising side supports which are adjustably tied together at the top of the sides. Earth or stone is poured between the supports, allowed to set, and then the forms are removed.

U.S. Pat. No. 3,363,873 to Barber et al discloses forms for casting underwater structures which employs two buoyancy chambers arranged in spaced apart position, a superstructure connecting and supported by the chambers, which has downwardly extending sub-frames and carrier frames linked to inner sides of the sub-frames. Shuttering elements are mounted on the carrier frames and means is provided for advancing and retracting the carrier frames to move the shuttering elements into and out of operative position.

U.S. Pat. No. 3,626,348 to Beckman discloses a system for attaching bridge deck form hangers to bridge supports in order to pour a concrete deck. The hanger has a lower end which is embedded in the top surface of a girder and an upper end which extends over the edge of the girder to interconnect with the bridge deck form, in order to secure the form in position with respect to the girders.

U.S. Pat. No. 4,342,440 to Eyden discloses an apparatus for forming concrete decks which includes adjustable removable hangers depending from opposed walls, beams or girders to support adjustable ledgers. The ledgers support deck joists and decking upon which a concrete deck will be poured to form a slab supported on the walls.

While forming objects from concrete has been known in the prior art, none of the prior art references have disclosed a forming system to form benches which incorporate stone and/or other decorative components.

SUMMARY OF THE INVENTION

The present invention is directed to a forming system for constructing stone benches which incorporates a forming tray that has a central support extending therethrough. The central support is temporarily supported at opposite ends and temporary shoring is provided beneath the length of the forming tray. Concrete and stone are placed in the forming tray and allowed to set. Next, the set concrete and stone are removed from the forming tray and support legs are placed under the concrete and stone and they are lowered into final position.

It is an object of the present invention to provide a new and improved stone bench forming system.

It is an object of the present invention to provide a new and improved stone bench forming system which can be constructed easily and inexpensively.

It is an object of the present invention to provide a new and improved stone bench forming system which can be used without the services of a skilled mason.

These and other objects and advantages of the present invention will be fully apparent from the following description, when taken in connection with the annexed drawings.

BRIEF DESCRIPTION OF THE DRAWINGS

FIG. 1 is side view of the stone bench forming tray of the present invention.

FIG. 2 is an end view of the stone bench forming tray of the present invention.

FIG. 3 is a side view of one type of bench support used with the stone bench forming tray of the present invention.

FIG. 4 is a perspective view of the stone bench forming tray of the present invention.

FIG. 5 is a side view of another type of bench support used with the stone bench forming tray of the present invention.

DESCRIPTION OF THE PREFERRED EMBODIMENT

Referring now to the drawings in greater detail, FIG. 1 shows the stone bench forming system 1 of the present invention. The tray, as shown in FIGS. 1 and 2, can be made from metal or any other material that is strong enough to hold the combined weight of the stone and concrete that will be placed in the tray 2. Also, the tray shown in the drawings is generally semicircular, however, this is merely for illustrational purposes and other shapes can be used without departing from the scope of the invention.

The tray 2, as shown in FIG. 1, is supported by a plurality of tray supports 6 which can be formed of any type of material that will hold the combined weight of the tray 2, the concrete and the stones 7 that will be placed within the tray. A pipe or other lifting support 3 having ends 4 will be placed approximately aligned with the longitudinal axis of the tray 2 and will be supported by anchors 5 at opposite ends. In addition, chains 10 can be attached to the ends 4 for a purpose to be described below.

Once the tray and the various supports are positioned, the stone bench can be fabricated. Usually one face of the stone being used will have a "dress" face which is usually the most esthetically pleasing face of the stone. This face will be positioned against the inside wall of the tray 2. Next concrete 11 will be placed inside the tray to hold the stones 7 in position. It should be noted that only some of the concrete 11 is shown in FIG. 2 for reasons of clarity, however, concrete will be placed between all the stones 7 within the forming tray 2. More stones can be added with additional concrete to hold the additional stones in place. Generally the bench can be any shape, however, the top of the bench should be as flat as possible to provide a smooth, even surface. As the stone and concrete are added to the tray, the supports 6 will prevent the center portion of the tray 2 from distorting under their combined weight. In addition, the rod or pipe 3 will be fixed in place by the stones and concrete.

Once all the stones and concrete have been placed inside the forming tray 2, they will be allowed to cure for approximately three days. At that time the concrete will be firm enough to be removed from the forming tray2. This can be accomplished by utilizing a hoist such as an engine hoist which can be attached to the chains 10, which in turn are attached to the ends 4 of the rod or pipe 3. Since the rod or pipe 3 will be firmly held by the concrete surrounding the stones 7, the entire bench can be removed from the tray 2. Once the bench is removed, it can be washed with a hose or pressure washer to remove excess sand and lime from the concrete.

As seen in FIG. 2, the ends of the tray 2 are open. This will allow the user to position the dressed face of the stone so it will face outwardly from the open ends to present the best appearance on the ends of the bench. In addition, lips 9 could be provided on the top of the tray 2 to facilitate handling of the tray 2.

As seen in FIGS. 3 and 5, different shapes of bench supports or legs can be prepared to support the finished bench in whatever location is chosen. The legs or bench supports could be made from the same type of stone that is used in the fabrication of the bench (and can be formed in a similar fashion as the bench) or other materials could be selected. In any event, the material selected should have a relatively flat top 8 to mate with the underside of the bench.

Before setting the bench onto the supports or legs, the top of the legs or supports are coated with an appropriate epoxy. Then the bench is placed on the legs or supports and the epoxy is allowed to cure. This will provide a strong and permanent joint between the bench and the legs or supports.

Once the bench is placed in its final position, the ends 4 of the pipes could be removed in any conventional manner. As can be seen by the above description, using the forming system of the present invention, an ordinary homeowner can fabricate a decorative bench without the masonry skills normally needed for such a project.

Although the Forming System for Stone Benches and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A bench forming system for fabricating stone benches, wherein said forming system comprises:

a tray, said tray having a bottom, sides, and open ends, said tray also having inner walls and outer walls and a longitudinal axis extending from one open end to another open end, means for supporting said bottom of said tray, a lifting support positioned along said longitudinal axis, said lifting support having opposite ends, said lifting support being positioned away from said inner walls and said bottom of said tray, said opposite ends extending beyond said open ends of said tray, means for supporting said opposite ends of said lifting support.

2. The bench forming system as claimed in claim 1, wherein said tray is semi-circular.

3. The method of using the bench forming system as claimed in claim 1, wherein said method of use comprises:

placing said tray onto said means for supporting said bottom of said tray, placing said means for supporting said opposite ends of said lifting support in position, positioning said lifting support along said longitudinal axis and on top of said means for supporting said opposite ends of said lifting support, placing a first layer of stones along said inner walls of said tray, placing concrete between said stones, placing additional stones on said first layer of stones, placing concrete between said additional stones, continuing to place stones and concrete within said tray until said tray is filled, allowing said concrete to cure, removing said stones and concrete from said tray by applying a lifting means to said lifting support, washing said stone and concrete, and placing said stone and concrete on permanent supports.

4. The method of using the bench forming system as claimed in claim 3, wherein epoxy is placed on said permanent supports before said stone and concrete is placed on said permanent supports.

* * * * *